US010424448B2

(12) United States Patent
Goldman et al.

(10) Patent No.: US 10,424,448 B2
(45) **Date of Patent: *Sep. 24, 2019**

(54) PYROTECHNIC DISCONNECT WITH ARC SPLITTER PLATES

(71) Applicant: Tesla Motors, Inc., Palo Alto, CA (US)

(72) Inventors: Mark Goldman, Mountain View, CA (US); Jeff Cortes, Redwood City, CA (US); Jeffrey G. Reichbach, Belmont, CA (US)

(73) Assignee: TESLA, INC., Palo Alto, CA (US)

( * ) Notice: Subject to any disclaimer, the term of this patent is extended or adjusted under 35 U.S.C. 154(b) by 96 days.

This patent is subject to a terminal disclaimer.

(21) Appl. No.: 15/016,202

(22) Filed: Feb. 4, 2016

(65) Prior Publication Data

US 2017/0229268 A1 Aug. 10, 2017

(51) Int. Cl.

| | |
|---|---|
| ***H01H 39/00*** | (2006.01) |
| ***H01H 9/34*** | (2006.01) |
| ***H01H 9/36*** | (2006.01) |

(52) U.S. Cl.

CPC ..... *H01H 39/006* (2013.01); *H01H 9/342* (2013.01); *H01H 9/36* (2013.01); *H01H 39/00* (2013.01)

(58) Field of Classification Search

CPC .... H01H 39/00; H01H 39/006; H01H 37/761; H01H 33/72; H01H 33/76; H01H 9/342; H01H 9/36

USPC ..... 337/403, 414, 416

See application file for complete search history.

(56) References Cited

U.S. PATENT DOCUMENTS

| | | | | |
|---|---|---|---|---|
| 4,275,431 | A | 6/1981 | Swoish et al. | |
| 4,563,556 | A | 1/1986 | Goldstein | |
| 4,649,242 | A * | 3/1987 | Kralik | H01H 9/44 218/34 |
| 5,504,292 | A * | 4/1996 | Bennett | H01H 9/34 218/15 |
| 5,793,275 | A | 8/1998 | Iversen | |
| 5,990,572 | A | 11/1999 | Yasukuni et al. | |
| 6,408,758 | B1 | 6/2002 | Duguet | |
| 9,425,010 | B2 * | 8/2016 | Hentschel | H01H 39/006 |
| 2006/0049027 | A1 | 3/2006 | Iversen | |
| 2006/0145808 | A1 * | 7/2006 | Von Behr | H01H 39/006 337/401 |
| 2012/0048699 | A1 | 3/2012 | Almgren et al. | |

(Continued)

FOREIGN PATENT DOCUMENTS

| | | | |
|---|---|---|---|
| DE | 102012013491 | B3 | 9/2013 |
| WO | 2007134875 | A1 | 11/2007 |
| WO | 2015117878 | A1 | 8/2015 |

OTHER PUBLICATIONS

EPO machine translation of Gaduinat, WO 2015117878 A1.*

(Continued)

*Primary Examiner* — Jacob R Crum

(74) *Attorney, Agent, or Firm* — Garlick & Markison; Bruce E. Garlick; H. Shannon Tyson, Jr.

(57) ABSTRACT

A pyrotechnic disconnect comprises: a housing with at least a combustion chamber therein; a pyrotechnic charge in the combustion chamber; a busbar covering an opening of the combustion chamber, the busbar configured to be severed by activation of the pyrotechnic charge; and arc splitter plates arranged in the housing on an opposite side of the busbar from the combustion chamber.

18 Claims, 7 Drawing Sheets

(56) References Cited

U.S. PATENT DOCUMENTS

| | | | | |
|---|---|---|---|---|
| 2012/0127621 | A1 | 5/2012 | Knapp, Jr. et al. | |
| 2013/0056344 | A1 | 3/2013 | Borg | |
| 2013/0154352 | A1 | 6/2013 | Tokarz et al. | |
| 2013/0175144 | A1* | 7/2013 | Sprenger ..... | B23D 15/145 200/61.08 |
| 2014/0061161 | A1 | 3/2014 | Nakamura et al. | |
| 2014/0088809 | A1 | 3/2014 | Hermann et al. | |
| 2015/0200065 | A1* | 7/2015 | Koetter ..... | H01H 33/06 218/26 |

OTHER PUBLICATIONS

International Searching Authority; International Search Report and Written Opinion; International Application No. PCT/US2017/015210; dated Apr. 14, 2017; 9 pgs.

* cited by examiner

PYROTECHNIC DISCONNECT WITH ARC SPLITTER PLATES

BACKGROUND

Disconnects can be used in a variety of electrical circuits. A disconnect can be used to selectively interrupt the current that flows out of or into an energy storage device. For example, a battery pack (e.g., containing lithium-ion cells) can be protected by a disconnect. Such a battery pack can be used in an electric vehicle or as a stationary storage for electric energy, to name just two examples.

In demanding applications, the disconnect must interrupt very large currents in a fast and reliable manner. For example, the interruption of large currents has a tendency to create electric arcs, sometimes referred to as arc columns. Since the disconnect is often intended to improve safety of the electric system (by allowing it to be disconnected quickly), it is important that such electric arcs are then managed so as to not create a new hazard or risk further damage. At the same time, it is preferable that the disconnect not be overly complex or involve components that are unduly expensive.

SUMMARY

In a first aspect, a pyrotechnic disconnect comprises: a housing with at least a combustion chamber therein; a pyrotechnic charge in the combustion chamber; a busbar covering an opening of the combustion chamber, the busbar configured to be severed by activation of the pyrotechnic charge; and arc splitter plates arranged in the housing on an opposite side of the busbar from the combustion chamber.

Implementations can include any or all of the following features. The arc splitter plates comprise a ferrous material. Each of the arc splitter plates has a cutout facing toward an electric arc formed by the severing of the busbar. The cutout is essentially U-shaped. The busbar further comprises a hinge flexure configured to allow a busbar portion to swing away from the combustion chamber upon the severing. The arc splitter plates are arranged in a stack having a curvature so that the arc splitter plates are positioned progressively further away from a path taken by the busbar portion. The arc splitter plates are arranged in an essentially linear stack. The arc splitter plates are arranged to be essentially equidistant from a path taken by the busbar portion. The pyrotechnic disconnect further comprises an exhaust port from the housing. The exhaust port is positioned on an opposite side of the arc splitter plates from the busbar. The exhaust port is positioned on a same side of the arc splitter plates as the busbar. The exhaust port comprises a grating in a wall of the housing, the pyrotechnic disconnect further comprising a filter covering the grating. The grating and the filter are configured to allow gas from the activation of the pyrotechnic charge to help suppress an electric arc formed by the severing of the busbar. The pyrotechnic charge comprises an initiator charge and a gas generator charge. The pyrotechnic charge comprises a primary charge and a secondary charge, each of the primary and secondary charges comprising at least one selected from the group consisting of zirconium potassium perchlorate, zirconium tungsten potassium perchlorate, zirconium hydride potassium perchlorate, titanium potassium perchlorate, titanium hydride potassium perchlorate, boron potassium nitrate, black powder, and combinations thereof. The housing comprises at least a portion overmolded onto the arc splitter plates. The busbar comprises a weak point configured to facilitate the severing of the busbar. The weak point is on a face of the busbar oriented away from the combustion chamber. The combustion chamber is flared toward the busbar. The housing comprises at least two pieces that clamp around the busbar.

DETAILED DESCRIPTION

Figure 1:
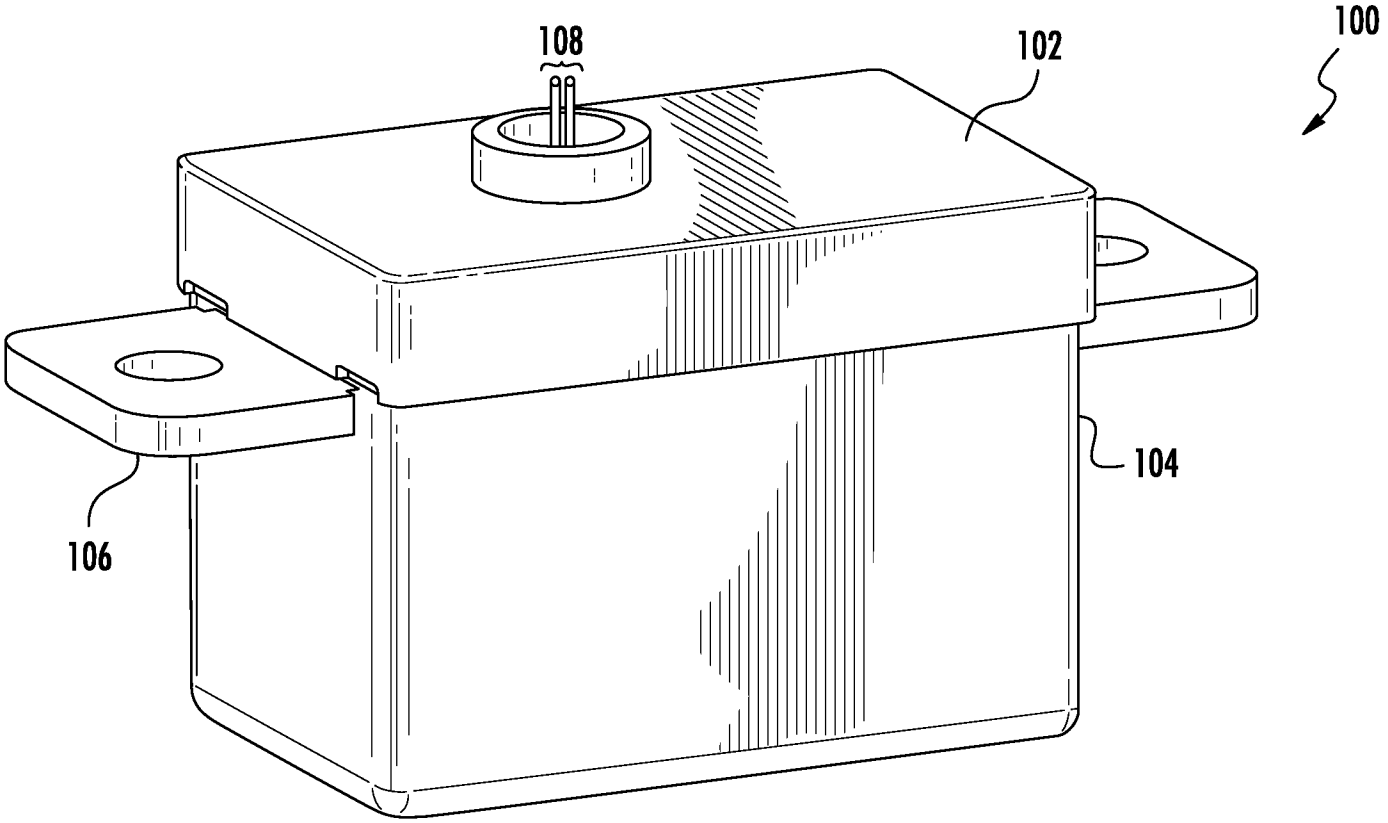
FIG. 1 shows an example of a pyrotechnic disconnect.

This document describes examples of systems and techniques for interrupting a current flow by severing a busbar, and for suppressing the electrical arc that is formed due to the severing. In some implementations, the arc is suppressed using arc splitter plates in the housing of a pyrotechnic disconnect. For example, such plates can suppress the arc by dividing it into multiple individual arcs. In some implementations, the arc is suppressed by a blast of gas from a pyrotechnic charge that is used for severing the busbar. For example, the gas blast can cool the electric arc, mix the plasma of the arc with surrounding air, and/or drive the arc into a stack of arc splitter plates. Some implementations that suppress the arc by a blast of gas may have arc splitter plates.

A disconnect can be used for interrupting current in a variety of implementations. In some of them, a pyrotechnic disconnect is designed to sever the electrical connection between an energy storage device (e.g., a battery pack) and another component (e.g., a motor or power electronics circuitry). For example, a pyrotechnic disconnect can be positioned inside or outside the pack. In either case, a disconnect can be designed so that it reduces the risk posed by the pyrotechnic charge's effluents or particles therein.

The disconnect can include an electrically insulated housing which holds a pyrotechnic charge, a conductive element, and a stack of steel arc splitter plates. The conductive element can be scored/notched in such a way that when the pyrotechnic charge is triggered, it severs and opens the conductor like a hinged lever. A combination of electro/ferro-magnetic interactions between the arc and splitter plates, and/or air/fluid dynamics of the combustion byproducts can cause the arc to be pushed out into the arc splitter plates. By dividing a single arc into multiple arcs in series, the splitter plates can greatly increase the total arc voltage, suppress the current flow and interrupt the circuit. The exhaust materials from the device can be ducted through a spark arresting filter element in order to allow the device to be housed in the same sealed volume as sensitive electronic components.

The pyrotechnic disconnect is used to protect against currents that are so large that they can pose a risk to equipment or people. For example, the disconnect can have a dedicated current sensor that detects the level of current flowing through a conductor, and this sensor can then directly or indirectly trigger the pyrotechnic device to initiate its charge. As another example, the pyrotechnic disconnect can be connected to another component (e.g., a battery management system) that already monitors the flowing current. Such a component can then be configured to send a signal to the disconnect when current of a certain level is detected. The previous examples are geared toward avoiding excessively large currents, but a pyrotechnic disconnect can also or instead sever an electric conductor in other situations, such as when there is little or no current. For example, this can be done as a precautionary measure. Some implementations of pyrotechnic disconnects will now be described.

FIG. 1 shows an example of a pyrotechnic disconnect 100. The disconnect includes a housing that here has an upper body 102 and a lower body 104. In other implementations, the housing can have a different number of parts. The housing can be made from any suitable electrically insulating material. In some implementations, the housing is made of plastic. For example, the upper and lower bodies can be respective injection molded parts.

The pyrotechnic disconnect includes a busbar 106 that is configured for conducting electricity in any direction through the disconnect. The busbar can also be severed, inside the housing, to interrupt any current flowing in the busbar, as will be exemplified below. The busbar here has a generally rectangular cross section at its ends extending from the housing. Intermediate these ends, on the other hand, the busbar can have a different shape, such as another profile. The busbar can be made from any suitable electrically conducting material(s). In some implementations, the busbar is made of aluminum.

Leads 108 extend from the upper body. These are connected to a pyrotechnic device mounted inside the housing, such as in the upper body thereof. An electrical pulse or other signal transmitted on the leads can trigger initiation of the pyrotechnic device, as will be exemplified below. For example, such pulse or signal can be sent by a current sensing device.

As such, the pyrotechnic disconnect 100 shows an example of an implementation where the housing includes at least two pieces that clamp around the busbar so as to form the disconnect into a complete unit.

Figure 2:
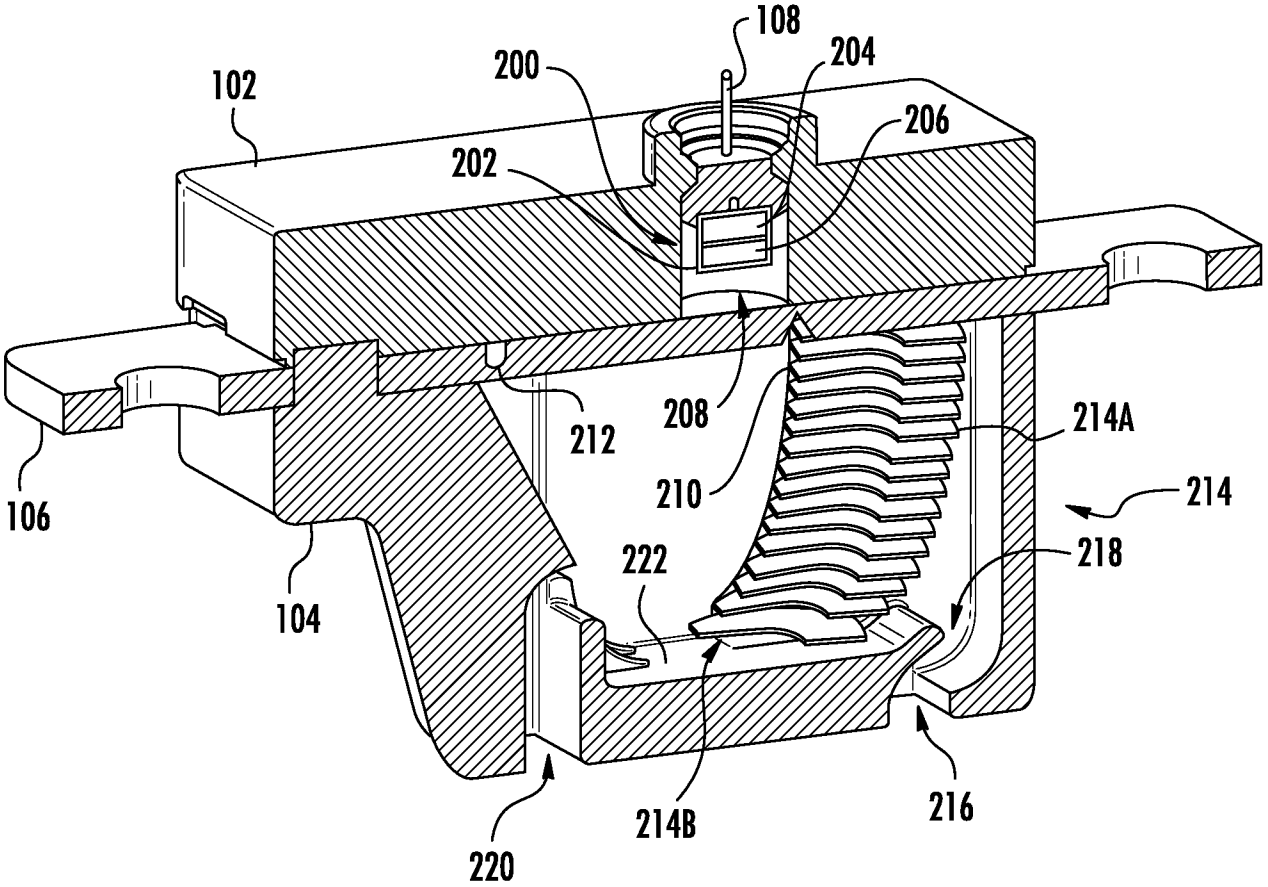
FIG. 2 shows an example cross section of the pyrotechnic disconnect in FIG. 1.

FIG. 2 shows an example cross section of the pyrotechnic disconnect 100 in FIG. 1. This view shows the disconnect from the opposite side as compared to the previous figure. In any case, the disconnect is shown with the upper body 102, lower body 104, busbar 106 and one of the leads 108.

The lead 108 is coupled to a pyrotechnic charge 200 that in this example is positioned within the upper body. Any of various pyrotechnic charges can be used, such as those that will be exemplified below. Here, the pyrotechnic charge is included within a can 202 and in general includes a primary charge 204 and a secondary charge 206. In some implementations, the leads 108 can terminate at the respective ends of a bridge wire inside the pyrotechnic charge. For example, a ceramic part can be used to hold the bridge wire and the ends of the leads. The primary charge 204 can be packed around the bridge wire. In some implementations, the secondary charge is then packed near or adjacent to the primary charge in the can. For example, a foil can be placed in between the charges. In some implementations, the can has scores on at least one side to facilitate rupturing. The pyrotechnic initiator can require a voltage to be applied across both leads to drive a current through the bridge wire and cause it to melt.

The respective chemistry or chemistries of the primary and secondary charges can be chosen depending on the desired performance in severing the busbar. The main function of the primary charge can be to break and open the busbar. In some implementations, the primary charge includes an initiator charge that can be configured so that it burns at a higher rate and at a higher temperature than the secondary charge. For example, the primary charge can be a very fast burning charge having a chemical reaction that essentially produces only solid output and no gas. As such, the energy of such a charge comes essentially all from heat energy. In some implementations, a fast-burning, brissant material can be used, including, but not limited to, zirconium potassium perchlorate, zirconium tungsten potassium perchlorate, zirconium hydride potassium perchlorate, titanium potassium perchlorate, or titanium hydride potassium perchlorate.

The secondary charge, in turn, can include a gas generator charge. The main function of the secondary charge can be to move the arc created by the severed busbar, and/or to cool the arc and mix it with surrounding air, and/or to help evacuate effluent from the disconnect device. In some implementations, the chemicals in such a charge have several stages of reaction, including some that release gasses. That is, such a charge does not merely turn solids into other solids, or merely release heat, but rather turns solids into a combination of solids and gasses, and also releases heat. Any suitable slow-burning, gas generating charge can be used, including, but not limited to, boron potassium nitrate, or black powder. In some implementations, any of the primary charge materials could be used in the secondary charge, and/or vice-versa. For example, multiple of the primary charge materials can be used as the secondary charge.

Here, the pyrotechnic disconnect has a single pyrotechnic charge. In other implementations, however, different numbers of charges can be used. For example, two or more similar or identical charges can be used in the same disconnect, such as for redundancy purposes or to increase performance. As another example, the primary charge(s) and the secondary charge(s) can be separate devices that can be triggered simultaneously or in a staggered fashion.

The pyrotechnic charge 200 is positioned within a combustion chamber 208. In this example, the combustion chamber is located in the upper body of the pyrotechnic disconnect. For example, the pyrotechnic charge can be placed toward an inner end of the combustion chamber where one or more openings are provided to accommodate extension of the leads out of the housing. In general, the combustion chamber serves to hold the pyrotechnic charge before deployment and to direct the blast toward the busbar upon activation. The combustion chamber can have any suitable shape. In some implementations, the chamber can be flared on some or all sides toward the opening that faces the busbar. In some implementations, a radially symmetric shape can be used.

The busbar 106 is positioned against the opening of the combustion chamber so as to receive the blast from the pyrotechnic device and be severed thereby in at least one place. In some implementations, the busbar has a notch 210 that facilitates severing. The notch can have any suitable shape, including, but not limited to, a V-shape. The notch can be placed on the face of the busbar that is oriented away from the opening of the combustion chamber. This can help create a seal between the busbar and the opening. For example, a sealing material such as silicone can be applied on the surface. In other implementations, a soldered, brazed, or welded joint can serve as the weak point where the fracture should occur.

The busbar can provide a feature that helps facilitate the severing by the deployment of the pyrotechnic charge. In some implementations, the pyrotechnic blast should cause the portion of the busbar that extends across the opening of the combustion chamber to swing away therefrom in a hinged fashion. For example, a hinge flexure 212 can be provided to help the busbar portion swing away from the combustion chamber toward the lower body 104.

The pyrotechnic disconnect here also includes an arc splitter plate assembly 214 inside the lower body 104. The assembly is designed to suppress formation of an electric arc when the busbar is severed by the pyrotechnic deployment. For example, when such arc is formed it can be drawn into contact with some or all of the plates and thereby be divided into smaller arcs of less voltage. The assembly includes multiple arc splitter plates 214A that here are arranged in form of a stack. For example, some or all of the plates can be essentially parallel to the busbar. The arc splitter plates have a cutout 214B that is here symmetrical on both sides of a centerline of the plate (in this illustration, only one of the sides is visible on each plate). The arc splitter plates can be made of any ferrous material, including, but not limited to, steel. More or fewer plates than in the present examples can be used in some implementations. The size of plates, and the spacing(s) between them, can be chosen depending on the particular implementation, such as based on the overall size of the disconnect and the levels of system inductance, voltage and/or current that are expected to occur. The plates can be mounted in any of a variety of ways, including, but not limited to, that the housing has slots or grooves each adapted to hold one plate. Such slots/grooves can be located on the inside of one or more walls in the housing, to name just one example.

Another example of a method of assembling and containing the splitter plates includes overmolding them with an injection molded carrier. In some implementations, this involves using a steel tool in an injection molding machine. In the tool, the splitter plates are arranged in the configuration that they are intended to have in the finished product. For example, this can involve placing the plates spaced apart from each other in a stack, optionally such that they are offset from each other corresponding to a spline or other curve. A material can then be overmolded onto edges of the splitter plates in the stack so as to form at least part of the housing for the disconnect. The tight fit of the tool can ensure that certain portions of the plates (e.g., their centers and cutouts) do not become covered with molding material. For example, the separation between plates in the stack and the viscosity of the molding material can be selected so as to reduce penetration of the material in the spacing between the plates during the molding process.

The plates can be arranged in a variety of configurations, such as in a stack as shown. Here, the stack has a curvature such that at the top thereof, the front edges of the plates are essentially aligned with the near edge of the combustion chamber opening, and such that at the bottom of the stack the front edges are closer to the far edge of the combustion chamber opening. Along the stack the plate placement can vary according to a regular pattern, such as a curve. For example, the busbar portion swings away from the combustion chamber as a result of the busbar being severed, and this busbar portion can trace an essentially circular path; the stack can then be shaped (e.g., according to a curve) so that the plates are positioned progressively further away from that circular path. In other implementations, the stack of arc splitter plates can have another shape. For example, the stack can be linear, or the edges of arc splitter plates can be equidistant from the path of the busbar.

The housing can have one or more exhaustion ports. The purpose of such a port can be to allow effluents from the pyrotechnic deployment to exit the housing. Here, a port 216 is positioned at the bottom of the housing but could be placed elsewhere. This port is positioned on an opposite side of the arc splitter plates 214 from the busbar 106. For example, a passageway 218 can allow gas that flows between the plates to continue toward the port. A filter can be provided at the port 216 and/or in the passageway 218, such as to catch particles traveling with the gas.

A port 220 can be positioned at the bottom of, or elsewhere on, the housing. Here, the port is positioned on a same side of the arc splitter plates 214 as the busbar 106. In some implementations, this port can allow some gas to escape the housing without first passing between the arc splitter plates. For example, the configuration of this port can allow tuning of the gas flow through the arc splitter plates by diverting some of it. This opening can be provided with a filter. In other implementations, the port 220 is omitted such that the flow is through a single port (e.g., the port 216).

The following is an example of operation by the pyrotechnic disconnect 100. When the pyrotechnic charge is deployed, the blast severs the busbar and swings it toward an open position. This causes an electric arc to form between the respective busbar edges that were created in the severing. A combination of electro/ferro-magnetic interactions between the arc and the splitter plates, as well as air/fluid dynamics of the combustion byproducts can cause this arc to be pushed out into the arc splitter plates. This can cause the single arc to be divided into multiple arcs in series with each other. In doing so, the splitter plates can increase the total arc voltage, thereby suppressing the current flow and interrupting the circuit. The exhaust materials from the pyrotechnic device can be ducted through a spark arresting filter element. For example, this can allow the disconnect to be housed in the same sealed volume as sensitive electronic components.

As such, with reference again to FIG. 1, the examples show that the pyrotechnic disconnect 100 has the housing including the upper body 102 and the lower body 104. The combustion chamber 208 is formed therein and here holds the pyrotechnic charge 200. The busbar 106 covers the opening of the combustion chamber and is configured to be severed by activation of the pyrotechnic charge. The arc splitter plates 214, moreover, are arranged in the housing on an opposite side of the busbar from the combustion chamber. The examples also show that the exhaust port 216 and/or 220 can be formed in the housing, and that it can facilitate suppression of an electric arc formed by the severing of the busbar gas from the activation of the pyrotechnic charge. The housing here includes a wall 222 that in this example forms the bottom of the housing. For example, this wall can be defined by the ports 216 and 220 in some implementations.

Figure 3:
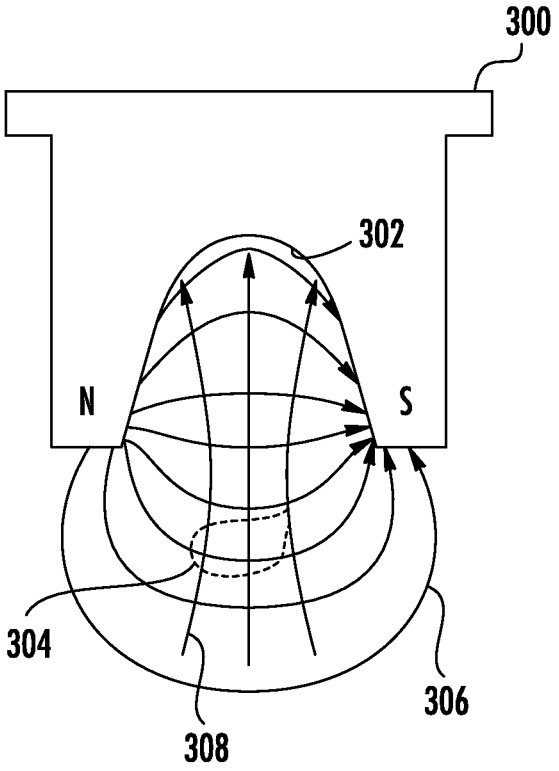
FIG. 3 shows an example of an arc splitter plate.

FIG. 3 shows an example of an arc splitter plate 300. This plate can be used in any examples described herein. The plate is here generally rectangular and has a cutout 302 formed in one of its edges. The cutout in this example extends across more than half the width of the plate and has a generally U-shaped form. Other profiles of cutouts can be used. When used in a stack of arc splitter plates, the plate can be oriented with the cutout facing toward where an electric arc 304 is expected to form. This arc is caused by the separation in the conductive path that occurs when the busbar is severed.

The arc generates a magnetic field, which temporarily magnetizes the splitter plates to form respective north and south magnetic poles therein, for example as indicated. The resultant magnetic field 306 of the splitter plates then draws the arc 304 into the plates, lengthening and stretching the arc. That is, the electromagnetic interaction creates a force vector, schematically illustrated by arrows 308, that is normal to both the current flow in the arc and the magnetic field lines. The arc current is here flowing perpendicular to the page, therefore the resultant force on the arc drives the arc deeper into the splitter plates. When the arc attaches to the splitter plates, it is divided into a multitude of arcs in series. Since each arc attachment point has a minimum voltage drop, increasing the number of arcs increases the total voltage, suppressing the arc. In addition to this, the gas discharge from the pyrotechnic can be directed through the splitter plates. This helps to direct the arc deeper into the splitter stack, and high velocity, turbulent air from the initiator can cool the plasma column and mix it with the surrounding air in the housing. Accordingly, this can provide arc suppression in addition to, or instead of, the arc splitter plates.

Figure 4:
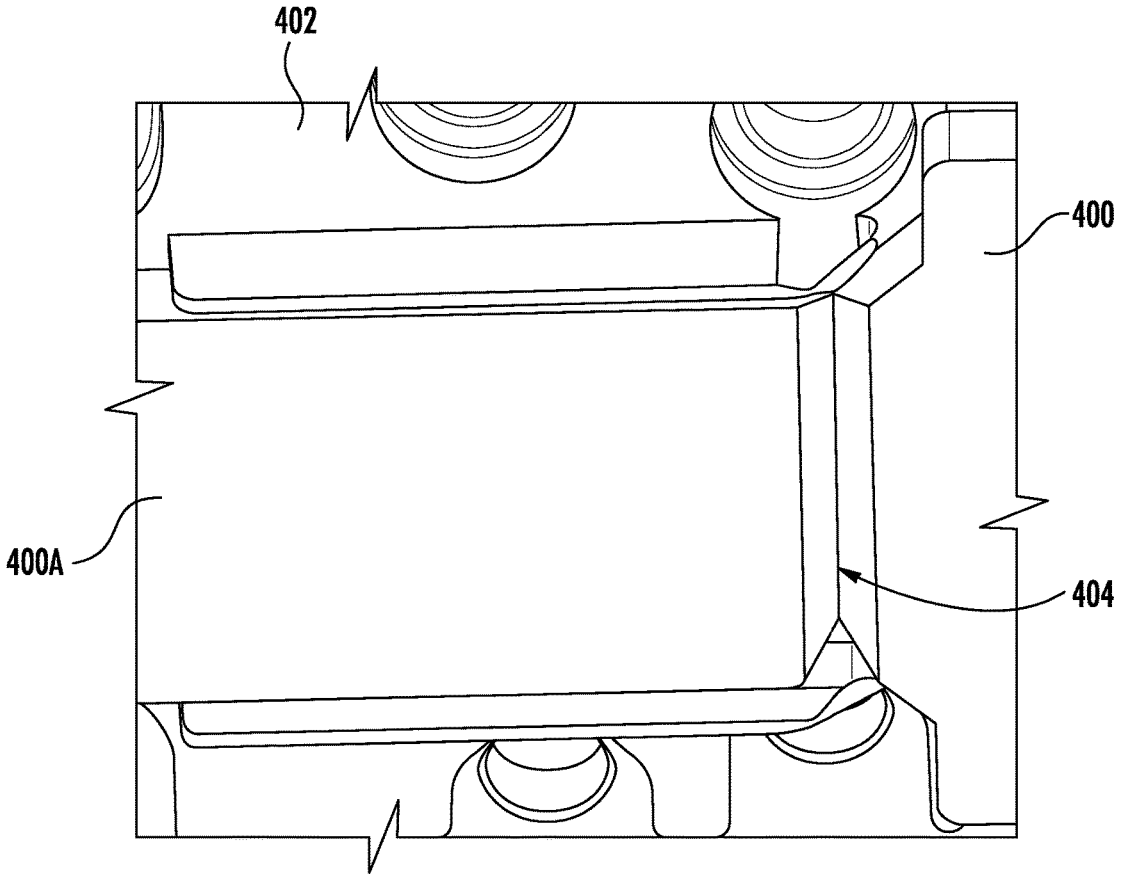
FIG. 4 shows an example of a busbar fitted against a combustion chamber in a pyrotechnic disconnect.

FIG. 4 shows an example of a busbar 400 fitted against a combustion chamber in a pyrotechnic disconnect 402. Here, the busbar is shown in a view from inside the housing, so the opening of the combustion chamber is hidden behind a busbar portion 400A. The busbar has a notch 404 formed in it where the busbar is intended to be severed by the blast of the pyrotechnic deployment. That is, the busbar portion is intended to swing away from the combustion chamber after the severing, thereby interrupting the flow of current through the busbar.

Figure 5:
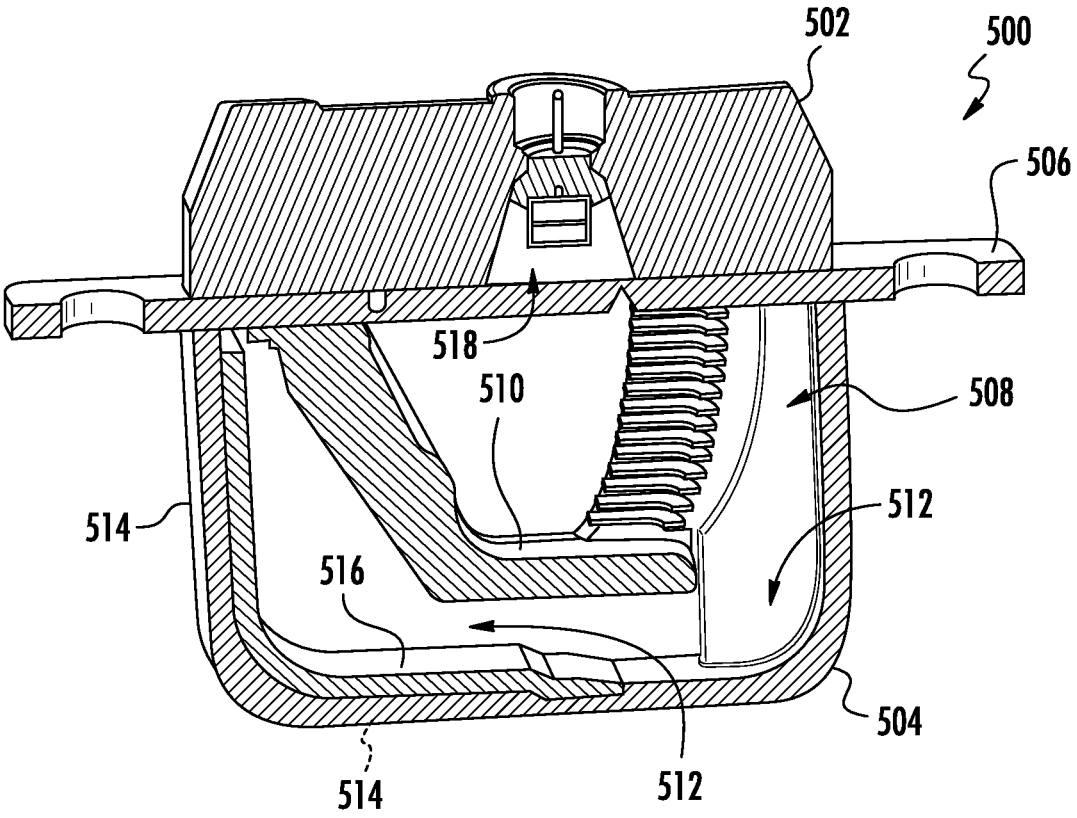
FIG. 5 shows a cross section of another example of a pyrotechnic disconnect.

FIG. 5 shows a cross section of another example of a pyrotechnic disconnect 500. Here, the disconnect includes an upper body 502 and a lower body 504 that are clamped around a busbar 506. Arc splitter plates 508 are arranged inside the housing, in this example as a stack that has a curved configuration. The housing here includes a wall 510 that in this example is positioned inside the walls of the housing. The wall here serves to define a passage 512 that runs behind the stack of arc splitter plates and continues along the bottom wall of the housing. The lower body 504 can have the arc splitter plates inserted therein after it is manufactured, or the housing (or part thereof) can be created by overmolding a carrier onto the plates, to name just two examples.

One or more of the housing walls in the pyrotechnic disconnect 500 can have an exhaust port. Here, for example, gratings 514 are provided in a side wall and in the bottom wall (obscured). For example, the grating can include an array of openings through the wall material. One or more filters can be provided for blocking sparks or other particles from exiting through the port(s). Here, for example, a filter element 516 is shown. Any suitable type of filter(s) can be used. In some implementations, the element includes a porous or fibrous, temperature resistant material, for example fiberglass or ceramic fibers. The grating and the filter can help the gas from the activation of the pyrotechnic charge suppress an electric arc formed by the severing of the busbar. For example, the fact that gas is allowed to escape through the port(s)—while effluent particles can be arrested—can allow the gas blast to suppress the arc by cooling it, mixing it with surrounding air, and/or by driving the arc into splitter plates. Accordingly, the type of filter and/or the size of the exhaust port can be selected so that sufficient gas flow out of the housing is provided.

A combustion chamber 518 can have any of a variety of shapes, including, but not limited to, a straight shape or a flared shape. For example, the flare can widen towards the opening so that the chamber presents an increased area towards the busbar portion that receives the blast. The chamber can be designed with any of a variety of depths between the opening and its far end. For example, the depth can be chosen to provide a suitable placement for the pyrotechnic charge, and to reduce the likelihood of arcing or creepage paths forming between the severed busbar edge and what remains of the pyrotechnic charge after the deployment.

Figure 6:
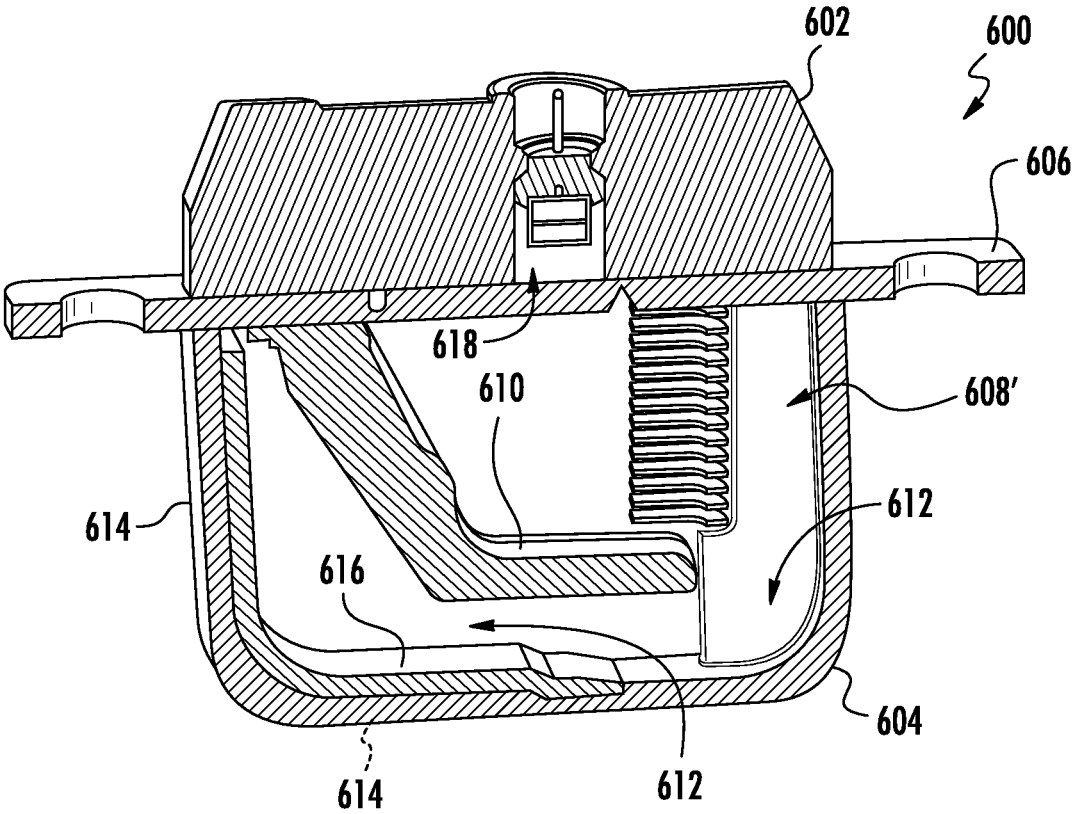
FIG. 6 shows a cross section of another example of a pyrotechnic disconnect.

FIG. 6 shows a cross section of another example of a pyrotechnic disconnect 600. Some components are similar or identical to those shown in the previous example. For example, the pyrotechnic disconnect here includes an upper body 602, a lower body 604, a busbar 606, a wall 610, a passage 612, gratings 614 and a filter element 616. Arc splitter plates 608 can be of a similar material and/or configuration as any or all other examples herein. In addition, the arc splitter plates 608 are arranged in an essentially linear stack. For example, the stack does not follow the arc traced by the busbar as it swings to its open position.

Figure 7:
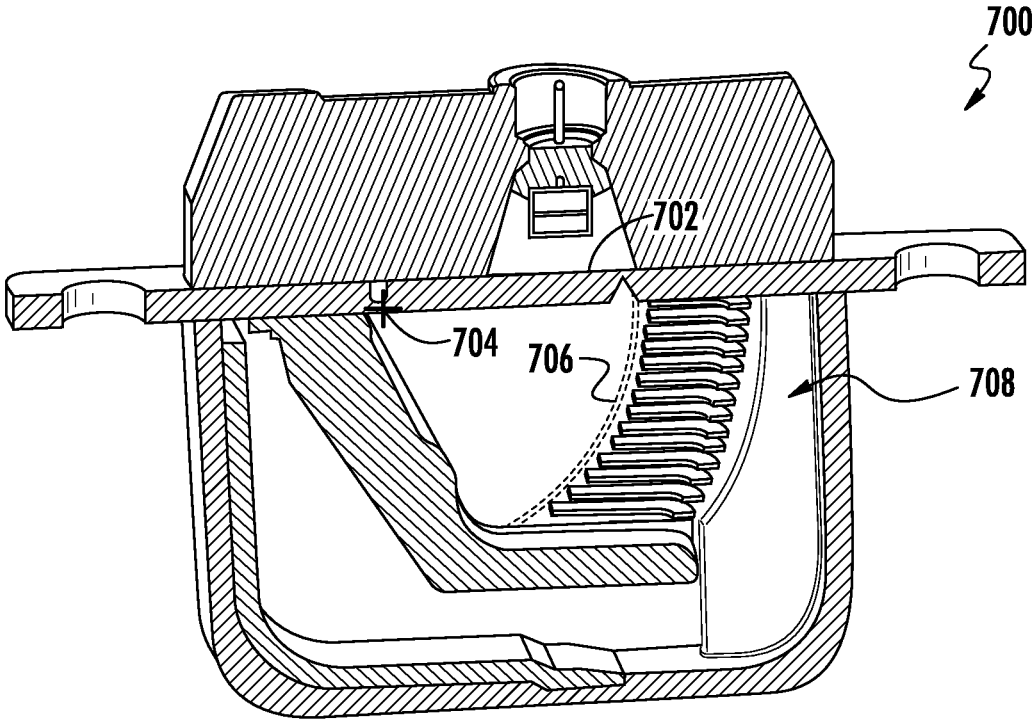
FIG. 7 shows a cross section of another example of a pyrotechnic disconnect.

FIG. 7 shows a cross section of another example of a pyrotechnic disconnect 700. Some components are similar or identical to those shown in previous examples. A busbar portion 702 is configured to be severed by the deployment of a charge in a combustion chamber. The chamber can have any of multiple shapes, including, but not limited to, a straight or flared shape. The busbar portion then swings about a hinge that is here represented by a mark 704. For example, this rotation can be facilitated by a hinge flexure in the busbar. The busbar portion traces a circular path 706 as it swings, the path depending on the position of the hinge and on the length of the busbar portion. A stack 708 of arc splitting plates is here arranged so that the plates are essentially equidistant from the path 706.

A number of implementations have been described as examples. Nevertheless, other implementations are covered by the following claims.

What is claimed is:

1. A pyrotechnic disconnect comprising:

a housing having an upper body and a lower body, the upper body including a combustion chamber therein;

a pyrotechnic charge in the combustion chamber;

a busbar residing between the upper body and the lower body, the busbar having a first end portion, a second end portion, and a swingable portion, the swingable portion located between the first end portion and the second end portion, having a severable end coupled to the first end portion and located adjacent the combustion chamber, and having a hinged end coupled to the second end portion;

a plurality of arc splitter plates arranged in the lower body and spaced apart vertically with first ends of the plurality of arc splitter plates forming a circular shape, wherein:

prior to discharge of the pyrotechnic charge, the busbar is configured to conduct electricity; and during discharge of the pyrotechnic charge, the severable end is severed from the first end portion and the swingable portion swings about the hinged end such that the severable end follows a circular path that is approximately equidistant from the circular shape of the first ends of the plurality of arc splitter plates; and a first exhaust port formed in the lower body of the housing, the first exhaust port configured to allow gas generated by discharge of the pyrotechnic charge to escape the housing; and a filter covering the first exhaust port.

2. The pyrotechnic disconnect of claim 1, wherein the arc splitter plates comprise a ferrous material.

3. The pyrotechnic disconnect of claim 1, wherein each of the arc splitter plates has a cutout facing toward the severable end during discharge of the pyrotechnic charge.

4. The pyrotechnic disconnect of claim 3, wherein the cutout is essentially U-shaped.

5. The pyrotechnic disconnect of claim 1, wherein the arc splitter plates are arranged in a stack.

6. The pyrotechnic disconnect of claim 1, further comprising a second exhaust port formed in a wall of the lower body of the housing.

7. The pyrotechnic disconnect of claim 1, wherein the first exhaust port is positioned on an opposite side of the arc splitter plates from the busbar.

8. The pyrotechnic disconnect of claim 7, further comprising a second exhaust port formed the lower body of the housing, wherein the second exhaust port is positioned on a same side of the arc splitter plates as the busbar.

9. The pyrotechnic disconnect of claim 1, wherein the first exhaust port comprises a grating in a wall of the housing.

10. The pyrotechnic disconnect of claim 1, wherein the pyrotechnic charge comprises an initiator charge and a gas generator charge.

11. The pyrotechnic disconnect of claim 1, wherein the pyrotechnic charge comprises a primary charge and a secondary charge, each of the primary and secondary charges comprising at least one selected from the group consisting of zirconium potassium perchlorate, zirconium tungsten potassium perchlorate, zirconium hydride potassium perchlorate, titanium potassium perchlorate, titanium hydride potassium perchlorate, boron potassium nitrate, black powder, and combinations thereof.

12. The pyrotechnic disconnect of claim 1, wherein the housing comprises at least a portion overmolded onto the arc splitter plates.

13. The pyrotechnic disconnect of claim 1, wherein the severable end is a weak point in the busbar.

14. The pyrotechnic disconnect of claim 1, wherein the combustion chamber is flared toward the busbar.

15. The pyrotechnic disconnect of claim 1, wherein the upper body and the lower body clamp around the busbar.

16. The pyrotechnic disconnect of claim 13, wherein the weak point comprises a notch in the busbar.

17. pyrotechnic disconnect of claim 16, wherein the notch has a V-shape.

18. The pyrotechnic disconnect of claim 13, wherein the weak point comprises a soldered, brazed or welded joint.

* * * * *